US005749434A

United States Patent [19]

Walcher et al.

[11] Patent Number: 5,749,434

[45] Date of Patent: May 12, 1998

[54] ROOF EDGE PROTECTION SYSTEM

[75] Inventors: James G. Walcher, Willard; James R. Limbird, Attica; Arthur C. Herner, Monroeville, all of Ohio

[73] Assignee: Safety Equipment Inc., Monroeville, Ohio

[21] Appl. No.: 226,128

[22] Filed: Apr. 11, 1994

[51] Int. Cl.[6] ..... E04G 3/12

[52] U.S. Cl. ..... 182/45; 52/749

[58] Field of Search ..... 182/45; 52/747–749

[56] References Cited

U.S. PATENT DOCUMENTS

| | | | |
|---|---|---|---|
| 3,983,676 | 10/1976 | Gilpin | 52/749 |
| 4,048,928 | 9/1977 | Wibben | 182/45 X |
| 4,068,446 | 1/1978 | Brueske | 182/45 X |
| 4,646,877 | 3/1987 | Whan | 182/45 X |
| 4,967,535 | 11/1990 | Alderman | 52/749 |

FOREIGN PATENT DOCUMENTS

| | | | |
|---|---|---|---|
| 603736 | 4/1978 | U.S.S.R. | 182/45 |

*Primary Examiner*—Alvin C. Chin-Shue
*Attorney, Agent, or Firm*—Ralph E. Jocke

[57] ABSTRACT

Apparatus for minimizing the risk of falls from the edge of a roof deck during installation of deck panels (14) on beam members (12) of a building frame, includes a platform (26). The platform includes frame members (32) that are rollably movable on the beam members. The platform is movable using a plurality of handles (38) which also operate to hold a safety line (62). A trailing edge (28) of the platform is maintained in closely adjacent relation to the front edge of a last placed deck panel. This minimizes the unsupported area between the last placed panel and the platform and avoids the risk of falls during installation of the roof deck.

9 Claims, 6 Drawing Sheets

ROOF EDGE PROTECTION SYSTEM

TECHNICAL FIELD

This invention relates to safety devices used in construction. Specifically this invention relates to an edge protection system to minimize the risk of falls during installation of a roof deck on a building frame.

BACKGROUND ART

Almost every building has a roof and when a roof is installed there is a risk of workers falling. Industrial buildings are usually constructed by first erecting a steel building frame or shell. The top of a shell has a series of beam members or purlins that extend longitudinally along the length of the roof. A roof deck is usually installed as panels that extend traversly across the beams and which are attached thereto.

A popular type of roof decking system is the standing seam type roof deck. In a standing seam system, adjacent deck panels are attached at crimped seams at their front and back. The seams extend the length of the panels. Anchors which attach the decking panels to the beam members include hook portions that attach to the seams. Insulation is installed between the inside of the deck panels and the frame members to reduce heat transfer to and from the inside of the building.

A standing seam type roof is installed by progressively laying down deck panels on the frame, front to back, along the length of the building. Currently workers who install standing seam type roof decks are required to work right at the leading edge of the last installed panel. This is because they must install an anchor to the underlying beam member to hold the front edge of the last panel. Then they place a new panel in position in front of the last panel and repeat the process.

The panels which make up the roof deck are long, heavy and awkward to handle, even for several workers. Persons working at the leading edge also must manipulate large mats of insulation. Doing this job outside in the elements, particularly when there is high wind, is very difficult. Further adding to the difficulty is that workers working at the leading edge of the roof system must wear a safety harness tied off to a safety cable to catch them in an event of a fall. This further restricts the worker's ability to move and adds to the difficulty associated with installing the roof deck.

Thus there exists a need for a roof edge protection system that makes installation of the roof deck easier and minimizes the risk of falls.

DISCLOSURE OF INVENTION

It is an object of the present invention to provide an apparatus for minimizing the risk of falls during installation of a roof deck.

It is a further object of the present invention to provide an apparatus that makes it easier to install a roof deck on a building frame.

It is a further object of the present invention to provide an apparatus that is readily configured for use with different sized roof decks.

It is a further object of the present invention to provide an apparatus that enables a worker to install roof deck panels without the need to wear a safety harness.

It is a further object of the present invention to provide an apparatus that aids in holding mats of insulation and minimizes the effects of high winds.

It is a further object of the present invention to provide a method for installing a roof deck that minimizes the risk of falls.

Further objects of the present invention will be made apparent in the following Best Mode for Carrying Out Invention and the appended claims.

The foregoing objects are accomplished in the preferred embodiment of the invention by an apparatus used in the installation of a standing seam type roof system. The roof deck is installed on a building frame having beam members that extend the length of the roof. The apparatus of the invention includes a platform that extends a substantial distance in the direction of the beam members. The platform includes channel-shaped frame members that are supported on the beam members. The frame members include rollers that facilitate movement of the platform along the frame members. The platform also has a trailing edge that extends traversly of the beam members.

The apparatus includes a long, curved handle that is attached near a leading edge of the platform. The handle extends above the platform and terminates at a tee end above the trailing edge. The tee end of the handle includes an aperture there-through that holds a safety line.

During installation of the roof deck, the platform is positioned so that its trailing edge is closely adjacent to a front edge of the last placed panel of the roof deck. The mats of insulation, which are usually much wider than the roof deck panels, are supported on the platform as the deck panels are being placed and are prevented by blowing off by the curved handle.

Each time a new roof panel is to be placed in position, the workers move the platform in the first direction so that the trailing edge is moved just enough so that a further deck panel can be placed in front of the last panel and an anchor may be attached to connect the underlying beam members of the building frame and the new deck panel. Once the new panel is anchored, the process is repeated.

The advantage of the present invention is that there is ideally never more than a very small gap between the trailing edge of the platform and the front edge of the last placed deck panel. This small gap is not open but is filled by the mats of insulation. As a result, when the invention is used properly a worker will not fall from the leading edge of the roof deck. In addition, the safety line extending through the handles of the invention keeps the workers away from the leading edge of the platform. This further helps to minimize the risk of falls.

BRIEF DESCRIPTIONS OF DRAWINGS

BEST MODE FOR CARRYING OUT INVENTION

Figure 1:
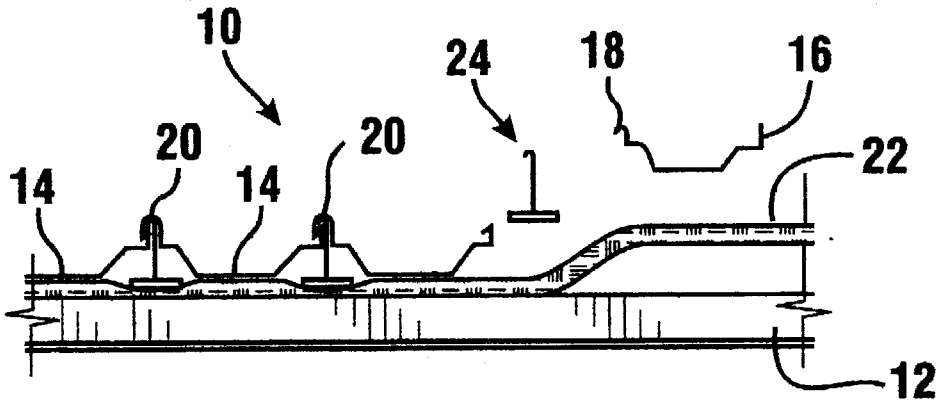
FIG. 1 (Prior Art)
FIG. 1 is a cross sectional exploded view of a standing seam type roof deck system of the type known in the prior art.

Referring now to the drawings and particularly to FIG. 1, there is shown therein a cross sectional view of a conventional standing seam type roof system generally indicated 10. The roof system is mounted on a building frame which has a plurality of beam members 12, which are commonly called purlins, that extend parallel and in a first direction along the length of the top of the frame. In the preferred embodiment of the invention, the beam members are the typed called "z-girt" a which have a generally z-shaped cross section. The beam members are conventionally spaced at five foot intervals.

The roof system includes a plurality of deck panels 14. The deck panels are preferably each two feet wide and may be a number of standard lengths. The deck panels are generally long and when placed extend in a direction traverse of the beam members 12, each deck panel is generally supported across its length by a number of the beam members. Each deck panel has a front edge 16, and a back edge 18 that extends the length of the panel. The front and back edges include in cross section interfitting tabs so that they may be joined together in crimped relation at seams 20. The preferred form of the invention is used in conjunction with the standing seam type system provided by American Buildings. However the invention may be used with other types of roof systems as well.

When the deck panels are installed on the beam members, mats 22 of insulation are sandwiched between the beam members and the panels. Anchors 24 are periodically fastened to the underlying beam member using fasteners extending through the insulation. The insulation is compressed under the lower plates of the anchors so that each anchor is rigidly attached to the underlying beam. Each anchor 24 has an upper hook-shaped portion that engages the panels in interfitting relation in the seams.

During installation of the standing seam roof system 10, workers are required to lay out a mat 22 of insulation which is generally about six feet in width. Deck panels 14 are then placed above the mat with the back edge of the newly placed panel engaged to the front edge of the previously placed panel. Anchors are then fastened to the underlying beam members near the front edge of the newly placed panel, and the hook portion of each anchor positioned to engage the newly placed panel at the front edge. The workers then place a further panel in front of the last panel and repeat the process attaching its back edge to the front edge of the prior panel (and the anchors). The workers then attach additional anchors at the front edge of the further panel so as to provide a further connection to the underlying beam members.

During the process of placing and anchoring deck panels, the workers are always positioned adjacent to the leading edge of the last placed panel. As a result, there is a need for protection against falls from the leading edge of the roof deck as the roof is being installed.

Figure 2:
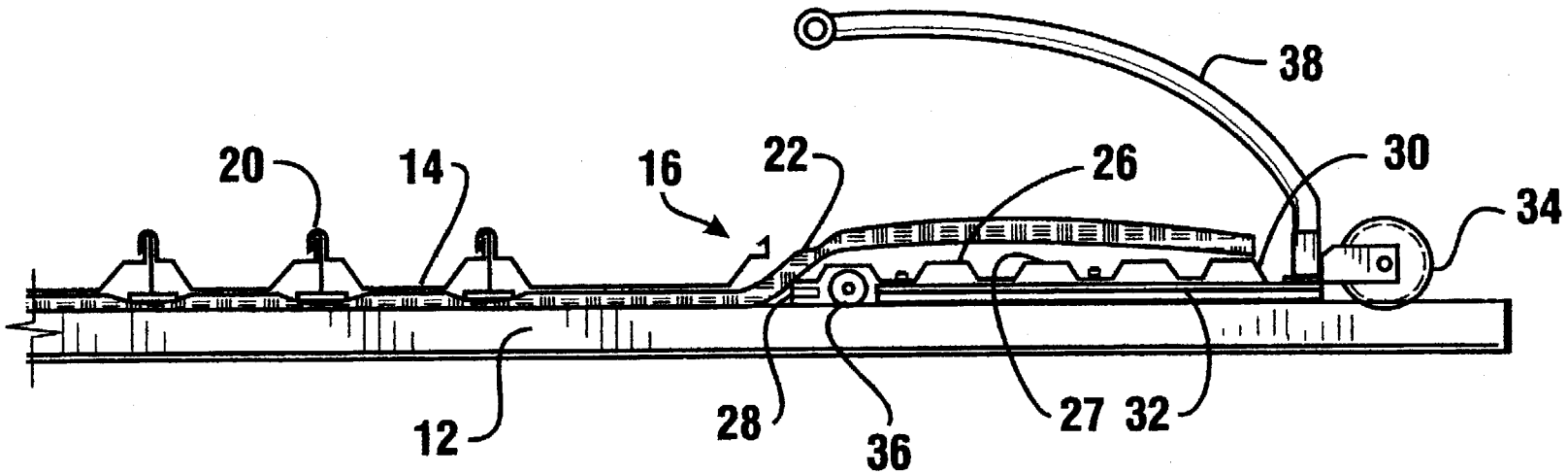
FIG. 2 is a cross sectional view of a standing seam type roof system and a preferred embodiment of the apparatus of the present invention.
Figure 3:
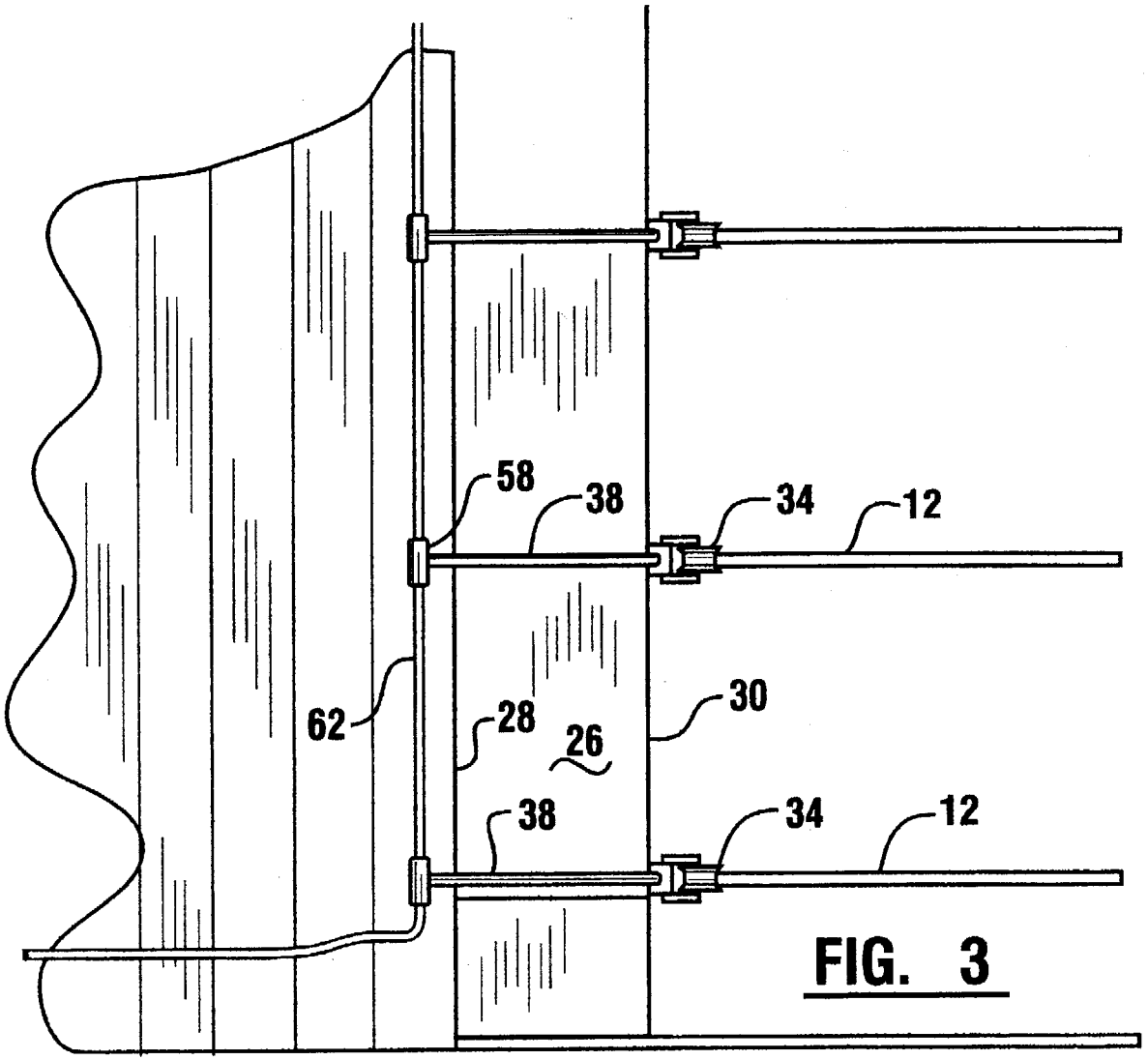
FIG. 3 is a top plan view of a partially installed roof deck being installed using the apparatus.

An apparatus of the present invention which is designed to minimize the risk of falls is shown in FIGS. 2 and 3. The apparatus includes a platform 26. The platform is preferably about seven feet wide. The platform includes a top plate 27. The platform has a trailing edge 28 and a leading edge 30. The trailing edge is a straight edge that is positionable along its length to the front edge 16 of a last installed deck panel 14.

Platform 26 includes frame members 32. The top plate 27 is attached to the frame members by conventional fasteners. The frame members 32 have mounted thereon a front flanged roller 34, and a rear roller 36. A handle 38 is also connected to each frame member.

Figure 5:
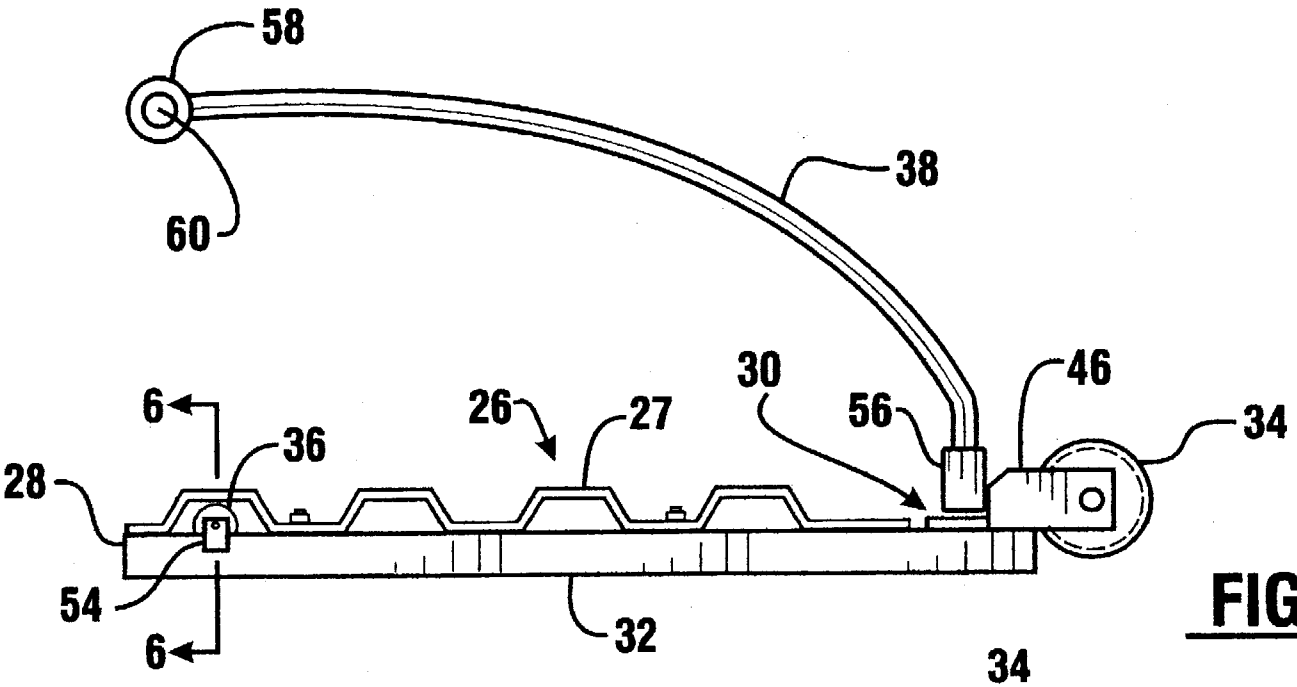
FIG. 5 is a side view of the platform, frame and handle of the apparatus.
Figure 7:
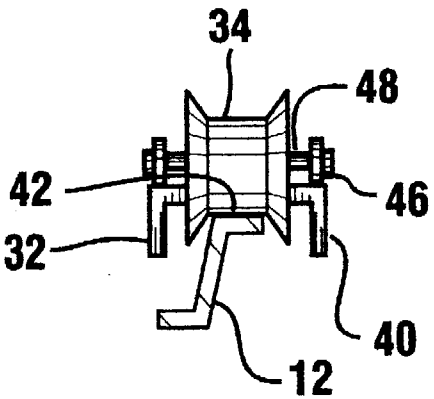
FIG. 7 is a partial front view of the frame member of the apparatus including the flanged roller supported on a beam member.
Figure 6:
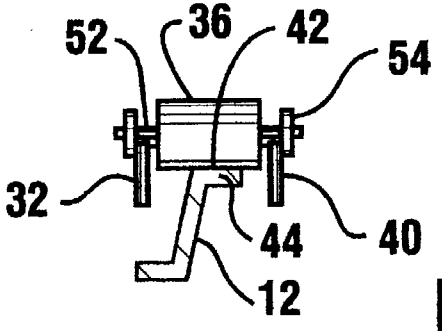
FIG. 6 is a sectional view of the frame member of the apparatus along line 6—6 in FIG. 5 with the frame member shown supported on a beam member.
Figure 8:
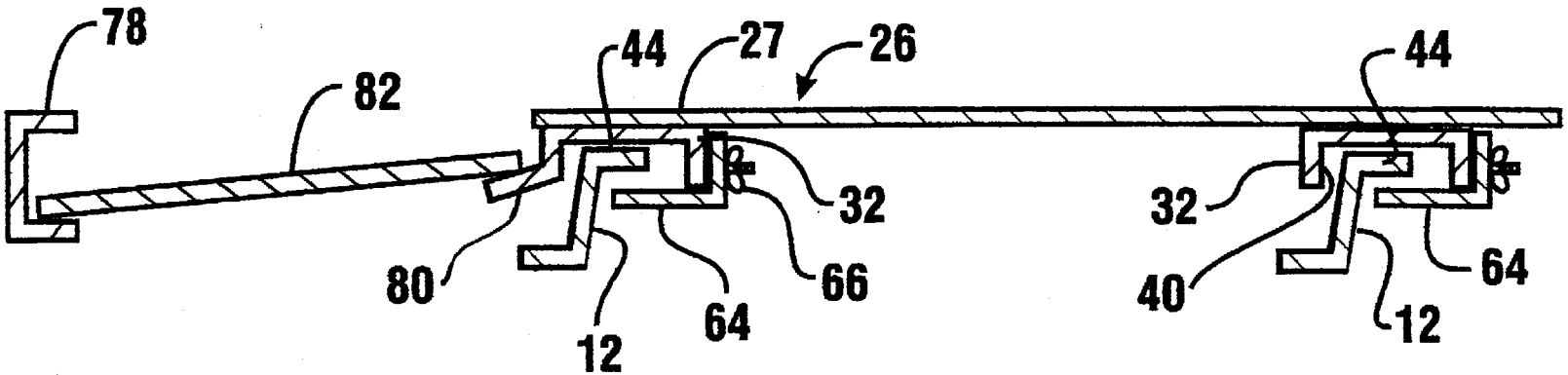
FIG. 8 is a front sectional view of a platform, frame members and a side platform shown supported on an eave channel.

As shown in greater detail in FIGS. 5 through 7, the frame members 32 are generally "u" shaped in cross section and include frame projections 40 extending downward on each side. The frame projections are of such length that a top surface 42 of a top flange 44 of a beam member nests between the frame projections as shown in FIGS. 7 and 8 when the frame member is mounted thereon. This provides for the frame members to move on the beam members in a guided tracked relation.

The flanged roller 34 is positioned between a pair of ear pieces 46 that extend from the frame member 32 in front of the leading edge of the platform. Each roller 34 is journalled on a shaft 48 that extends between the ear pieces. The flanged roller 34 includes radially extending projections 50 that serve to center the roller on the top surface 42 of a beam member.

The rear roller 36 extends through a cut out in the top surface of the frame member. It is journalled on a shaft 52 that extends between ear pieces 54. The rollers 34 and 36 support the frame member 32 and the platform 26 and enable it to move readily along the beam members.

The handle 38 is removably positioned in a cylindrical socket 56 on frame member 32. The handle 38 can be removed from the socket 56 when desired. The handle 38 is curved and extends above the top plate 27. It terminates at a tee end 58 which is at about waist level for an average worker.

The tee end includes an aperture 60. The aperture 60 is used for holding a safety line 62 or rope as shown in FIG. 3. An advantage of handle 38 which is demonstrated in FIG. 2, is that the large mat of insulation waiting to be placed in underlying position below the roof deck panels is held between the top plate of the platform and the handle until it is covered by the deck panel. This helps to prevent the mat from flapping in the wind which makes installation easier.

Figure 9:
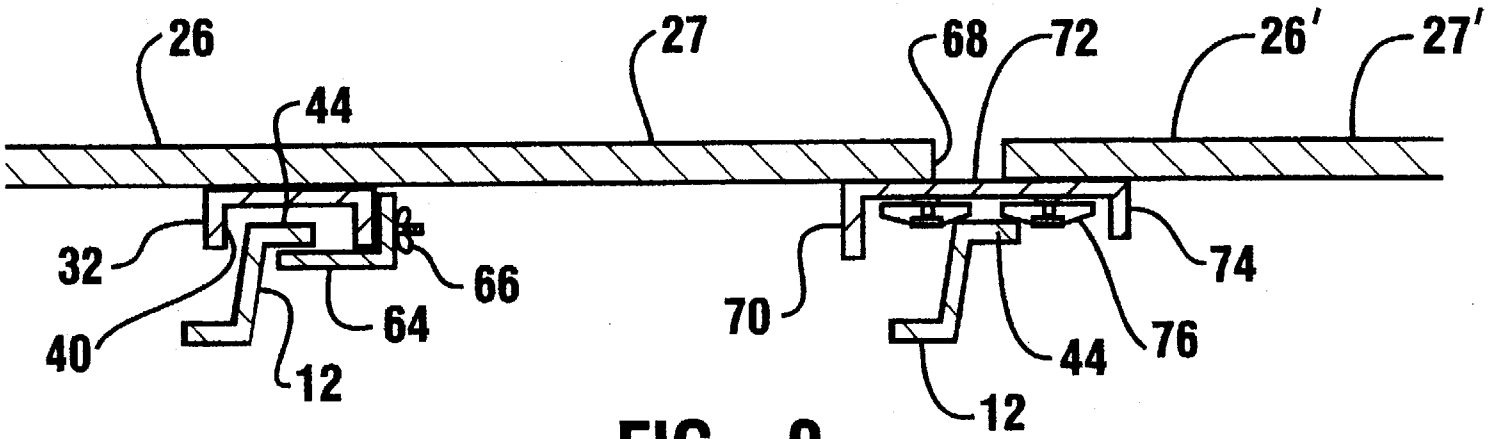
FIG. 9 is a front sectional view of a platform, frame member and a first side member.

As shown in FIGS. 8 and 9, the frame members 32 also have attached thereto finger members 64. The finger members are attached to a frame projection 70 using a wing nut 66 attached on a stud which extends through a hole in the finger member. The finger member extends below the top flange 44 of the adjacent beam member. The finger members further minimize the risk that the frame members will become disengaged from the beam members during movement of the platform. This is valuable in the event of unexpected wind gusts which might otherwise cause the platform to be blown off the beam members.

For ease of installation and use, the platform 26 is often made in several segments. As a result, segments of the platform are enabled to move slightly ahead of one another and the entire platform need not be moved at once.

Figure 11:
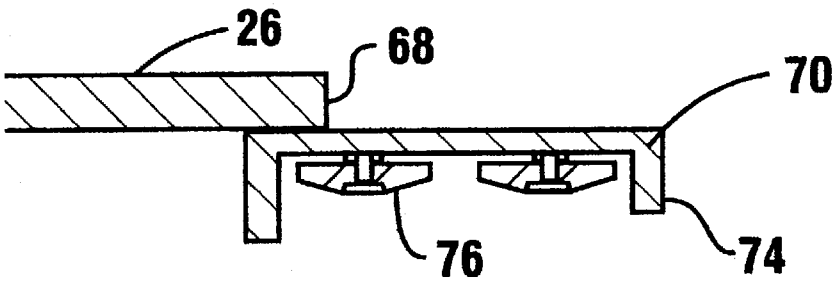
FIG. 11 is a front sectional view of a side member and the disc members thereon.
Figure 10:
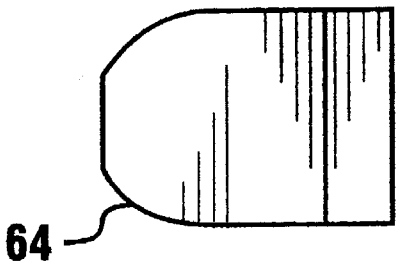
FIG. 10 is a top plan view of a finger member.

The platform is bounded at a side by a first side edge 68 as shown in FIGS. 9 and 11. A first side member 70 has a side projecting surface 72 that extends below the level of the top plate 27. This enables an adjacent platform 26' to move with its free cantilevered end of top plate 27' to move in supported relation on top of side projecting surface 72.

Side member 70 is similar in length to frame members 32 and extends the width of the platform. The side member has a pair of widely spaced side member projections 74. The side member projections, like frame projections 70, extend sufficiently downward to house the top flange 44 of a beam member in between. A pair of spaced disk members 76 are rotatably mounted on the underside of side member 70. The disk members 76 are conically tapered so as to roll on the top surface 42 of the beam surface and center the side member on the top flange 44 as the side member moves thereon As shown in FIG. 8, the side of the building frame is generally bounded by a "c" shaped eave channel 78. The frame member 32 closest to the eave channel in the preferred embodiment of the invention includes a side projection 80 that extends outward towards the eave channel. A side platform 82 is fastened to the side projection. The side platform 82 is designed to extend to the inside of the eave channel and slide on a lower surface thereof.

Figure 4:
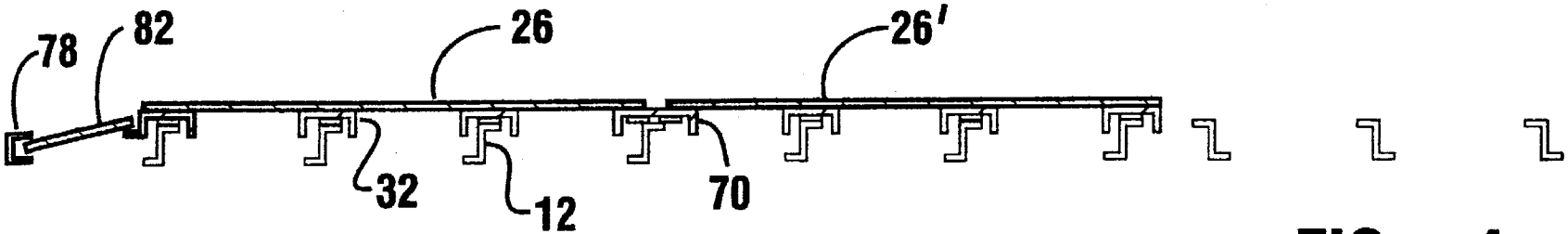
FIG. 4 is a cross sectional front view of a building frame and a platform of the apparatus of the present invention.

As shown in FIG. 4, the platforms 26, 26' move in supported relation on the beam members 12. Although as shown in FIG. 4, a frame member may be positioned on every beam member of the roof, it is often desirable to have the frame members separated by greater distances. Applicants have found that in most installations where the beam members are spaced five feet apart the system works satisfactorily if a frame member is positioned on only every fourth beam member. As shown in FIG. 4, the side member 70, which enables the platforms 26, 26' to be moved independently, is also supported on a beam member If the frame members of the platforms are widely spaced, it is usually desirable to have the side member positioned so that relatively consistent spacing of the frame members is maintained. This is helpful to achieve uniform force on the handles to move the platforms as well as to avoid long cantilevered ends on the platform 26' which may make the platform awkward to move.

One approach to using the present invention is to make the platforms conform in length to the length of the deck panels 14. In this configuration the platform 26 is moved in the first direction each time a new panel is placed in position. The platform is moved forward just enough to enable installation of the anchors 24 to the underlying beam members 12 near the front edge of the last placed panel. Once the anchors are in place, the next panel can be moved into position and the process repeated.

Throughout the process of installing the deck panels there is no opening through which a worker could fall. In addition, the handles with the safety line extending thereto maintains the workers at least seven feet away from the leading edge of the platform. This enables the worker to go about setting and anchoring the deck panels without having to wear a safety harness attached to a safety line. This makes doing the work much easier.

A further advantage of the apparatus of the invention is that the mats of insulation which are to be covered by the deck panels as they are installed are supported on the top plate of the platform. These mats of insulation have flexible facing material that must be spliced together as each six foot width mat is used. The platform makes it much easier to accomplish the stapling operation that must be done to secure the facing of the adjacent insulation mats. As discussed previously, in the preferred standing seam roof system used with the invention, the mats of insulation are six foot wide and run the length from the central span of the roof from centerline to the eave. However, in other systems where different lengths of insulation are used, the width of the platform may be varied to suit the particular configuration. For example, in other embodiments it may be desirable to integrate the functions of the platform with the holding of insulation material in compressed relation until it is ready to use. The compressible character of insulation makes this possible provided that a mechanism is provided on the platform for holding the insulation and delivering it rearward as needed.

The removable character of the handle 38 is important for a number of reasons. Often during the installation of roof decking it is desirable to place the deck panels in stacks on the beam members ahead of where workers are placing the deck panels. When it is time to move the deck panels from ahead of where the work is going on to behind the workers, workers must go forward of the platform 26 to hand these panels to other workers. When this is to be done, the workers who are to go forward of the platform attach themselves to an appropriate safety harness and safety lines and they remove the handles. With the handles removed, it is easier to hand the deck panels from the stacks, across the platform to the other workers.

Once the process of transferring the panels from the forward stacks is completed, the workers wearing the safety harnesses may reinsert the handles in place in the sockets. The installation of the deck panels may then resume in the manner previously described.

It should also be mentioned that while the apparatus of the present invention is primarily involved with leading edge protection, it is also necessary to provide for fall protection along the sides of the roof and in the back of the area where the workers are installing the roof deck panels. The safety line 62 which extends through the handles may also be extended about the periphery of the work area. Of course, other means for providing this protection may also be provided.

In the preferred form of the invention, the frame members are made as weldments. In other embodiments the frame members may be made by other construction techniques. Further, it is a fundamental aspect of the present invention that this system must be modular so that it may be reused for various installations. This is achieved by attaching the top plate 27 of the platform to the frame members with fasteners. This enables the top plates to be readily attached at a number of locations to frame members. It also enables the top plates to be comprised of overlapping metal sheeting of different lengths fastened to the frame members so as to form platforms of the desired width for the particular job being performed.

While in the preferred form of the invention the means for moving the platform includes a handle for manual movement, other embodiments of the invention may include other types of movement means. Other equivalent types of movement means which may be used in other embodiments of the invention would include drive systems for the platform including motors or pulleys, or any other apparatus that is used to selectively move the platform.

Thus the apparatus of the present invention achieves the above stated objectives, eliminates difficulties encountered in the use of prior devices and systems, solves problems and attains the desirable results described herein.

In the foregoing description certain terms have been used for brevity, clarity and understanding. However, no unnecessary limitations are to be implied therefrom because such terms are for descriptive purposes and are intended to be broadly construed. Moreover, the descriptions and illustrations given are by way of examples and the invention is not limited to the exact details shown and described.

Having described the features, discoveries and principles of the invention, the manner in which it is utilized and operated, and the advantages and useful results attained; the new and useful structures, devices, elements, arrangements, parts, combinations, systems, equipment, methods, operations and relationships are set forth in the appended claims.

We claim:

1. A method for minimizing the risk of falls during installation of a roof deck on a building frame, said building frame having a plurality of beam members extending in a first direction and wherein said roof comprises a plurality of deck panels extending traversely of said beam members, and wherein each said panel has a traversely extending front edge and back edge connectible to adjacent back and front edges of adjacent panels respectively, comprising the steps of:

placing a first deck panel in supported relation on said building frame; providing a platform supportably movable in said building frame, said platform having a trailing edge adjacent said front edge of said first deck panel;

supporting a second deck panel on said platform with a back edge of said second panel in abutting relation with the front edge of the first deck panel;

securing the back edge of said second deck panel to the front edge of said first deck panel while said second panel is supported on said platform; and moving said platform in the first direction on said building frame so that said second panel is no longer supported on said platform and said trailing edge of said platform is adjacent said front edge of said second deck panel.

2. The method according to claim 1 wherein said platform comprises a leading edge disposed in said first direction from said trailing edge, and a top plate, and further providing a handle extending in an opposed direction from adjacent said leading edge above said top plate, said handle extending in said opposed direction beyond said trailing edge, and wherein said moving step is accomplished by movement of said handle.

3. The method according to claim 1 wherein said platform includes frame members having a pair of traversly spaced frame projections, and accepting a beam member between said pair of frame projections, whereby said platform is guided to move in said first direction by said beam members between said frame projections.

4. The method according to claim 1 and further comprising the steps of spacing said trailing edge of said platform in the first direction from the front edge of said first deck panel a first distance sufficient to provide a space for acceptance of an anchor and insufficient for a worker to fall through, and further comprising the steps of connecting said anchor to at least one of said beam members through said space between the first deck panel and said platform, and connecting said anchor to at least one of said deck panels.

5. The method according to claim 4 wherein said back edge of said second deck panel and said front edge of said first deck panel are connected to the anchor.

6. The method according to claim 1 and further comprising the step of supporting a mat comprised of insulating material in underlying relation of said second deck panel when said second deck panel is supported on said platform, and wherein when said platform is moved in said first direction said mat is no longer in supported relation with said platform whereby said mat is fixably disposed between said deck panels and said beam members.

7. The method according to claim 1 wherein said platform further comprises a flanged roller having traversely spaced radially extending projections thereon, and wherein a beam member extends between said radially extending projections, and wherein in said moving step the platform is guided on said beam member.

8. The method according to claim 5 wherein said platform comprises a leading edge disposed in said first direction from said trailing edge, and a top plate, and further providing a handle extending from adjacent said leading edge in an opposed direction above said top plate, said handle extending beyond said trailing edge in the opposed direction, and further comprising the step of supporting a mat comprised of insulation on said platform, said mat extending of intermediate of said platform and said handle.

9. A method for installing a roof deck on a building frame while minimizing the risk of worker falls therefrom, wherein said roof deck comprises deck panels and anchoring devices, said anchoring devices having a width associated therewith required for connection thereof to said building frame, comprising the steps of:

placing a first portion of a first deck panel in connected relation with said building frame while a second portion of said first deck panel is supported on a movable platform, said second portion disposed from said first portion in a direction, and wherein said movable platform is supported on said building frame;

moving said movable platform in said first direction wherein said first deck panel is no longer supported on said platform and wherein said platform is disposed from said first panel in the first direction by a space, siad space closely corresponding to the width of said anchoring device;

connecting said anchoring device and said building frame through said space;

connecting said second portion of said first deck panel to said anchoring device;

placing a second deck panel in supported relation with said platform; and connecting said second deck panel to said anchoring device.

* * * * *